US011629719B2

(12) United States Patent
Zou et al.

(10) Patent No.: US 11,629,719 B2
(45) Date of Patent: Apr. 18, 2023

(54) ELECTRIC COOLANT PUMP AND MANUFACTURING METHOD FOR MOVABLE UNIT OF THE SAME

(71) Applicant: Johnson Electric International AG, Murten (CH)

(72) Inventors: Guoyuan Zou, Shenzhen (CN); Hongliang Zhang, Shenzhen (CN); Daigang Li, Shenzhen (CN); Anbang Chen, Shenzhen (CN); Ruifeng Qin, Hong Kong (CN); Guanyin Liang, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 674 days.

(21) Appl. No.: 16/553,678

(22) Filed: Aug. 28, 2019

(65) Prior Publication Data

US 2020/0072224 A1 Mar. 5, 2020

(30) Foreign Application Priority Data

Aug. 29, 2018 (CN) ..... 201810995722.3

(51) Int. Cl.
*F04D 13/06* (2006.01)
*F04D 29/58* (2006.01)
(Continued)

(52) U.S. Cl.
CPC ..... *F04D 13/0606* (2013.01); *F04D 13/0633* (2013.01); *F04D 29/046* (2013.01);
(Continued)

(58) Field of Classification Search
CPC ..... F04D 13/064; F04D 13/0606; F04D 13/0626; F04D 13/0633; F04D 29/026;
(Continued)

(56) References Cited

U.S. PATENT DOCUMENTS 5,949,171 A * 9/1999 Horski ..... H02K 1/02 310/43
7,101,158 B2 * 9/2006 Hembree ..... F04D 13/027 417/420
8,047,816 B2 11/2011 Fujii et al.
8,979,504 B2 * 3/2015 Snider ..... F04D 29/426 417/423.1
9,360,015 B2 * 6/2016 Muizelaar ..... F04D 29/426
9,568,012 B2 * 2/2017 Aso ..... F04D 13/064
2001/0043865 A1 * 11/2001 Rennett ..... F04D 29/0413 417/44.1
2005/0214135 A1 * 9/2005 Shibuya ..... F04D 29/0465 417/357
(Continued)

FOREIGN PATENT DOCUMENTS

DE 102015210703 A1 12/2016
WO WO-2009/037019 A1 3/2009

*Primary Examiner* — Dominick L Plakkoottam
(74) *Attorney, Agent, or Firm* — Muncy, Geissler, Olds & Lowe, P.C.

(57) ABSTRACT

An electric coolant pump includes a pump house, a motor connected to the pump house, and an impeller housed in the pump house and driven by the motor. The motor includes a stator and a movable unit rotatably mounted within the stator. The stator is provided with a central shaft. The movable unit includes a support body, a bearing assembly fixedly embedded in the support body, a rotor core fixed to the support body, and a plurality of permanent magnets attached to the rotor core. The bearing assembly includes at least one bearing rotatably sleeved on the central shaft. The support body is formed by an injection-molding process to wrap the bearing assembly and fixed connecting bearing assembly and the rotor core.

15 Claims, 12 Drawing Sheets

(51) Int. Cl.
*F04D 29/40* (2006.01)
*F04D 29/046* (2006.01)

(52) U.S. Cl.
CPC ..... *F04D 29/406* (2013.01); *F04D 29/588* (2013.01); *F04D 13/06* (2013.01); *F05D 2230/60* (2013.01); *F05D 2240/14* (2013.01); *F05D 2240/20* (2013.01); *F05D 2240/50* (2013.01); *F05D 2240/60* (2013.01)

(58) Field of Classification Search
CPC .... F04D 29/588; F04D 29/628; F04D 29/426; F04D 13/06; F04D 29/22; F04D 13/025; F04D 13/026; F04D 13/027; F04D 25/06; F04D 29/046; F04D 29/0465; F04D 29/20; F04D 29/2222; F04D 29/406
See application file for complete search history.

(56) References Cited

U.S. PATENT DOCUMENTS

2006/0057006 A1* 3/2006 Williams ..... F04D 13/0633 417/423.1
2007/0237660 A1* 10/2007 Akiyoshi ..... F04D 13/0626 310/86
2011/0033320 A1* 2/2011 Heier ..... F04D 13/0606 417/410.1
2016/0094099 A1* 3/2016 Moritz ..... F04D 29/628 29/598
2016/0248292 A1* 8/2016 Takarai ..... H05K 5/061
2017/0037855 A1* 2/2017 Yin ..... F04D 13/0633
2017/0082117 A1* 3/2017 Zhou ..... F04D 13/0686
2017/0093252 A1* 3/2017 Otsubo ..... F04D 13/064
2021/0180613 A1* 6/2021 Lundsted Poulsen ..... F04D 29/041

* cited by examiner

ELECTRIC COOLANT PUMP AND MANUFACTURING METHOD FOR MOVABLE UNIT OF THE SAME

CROSS REFERENCE TO RELATED APPLICATIONS

This non-provisional patent application claims priority under 35 U.S.C. § 119(a) from Patent Application No. 201810995722.3 filed in The People's Republic of China on Aug. 29, 2018.

FIELD OF THE DISCLOSURE

This present disclosure relates to a cooling fan module for a motor vehicle. In particular, the present disclosure relates to a cooling fan module with two motors.

BACKGROUND OF THE DISCLOSURE

An electric coolant pump generally includes a pump house, a motor connected to the pump house, and an impeller housed in the pump house and driven by the motor. The motor includes a stator and a rotor rotatably mounted within the stator. Bearings are disposed between the stator and the rotor to rotatably support the rotor. The bearing should be prevented from being loosen or fall off in work. Furthermore, high coaxiality of different bearings cooperatively supporting the rotor is request. Therefore, the bearings should be precisely processed, e.g. the outer and inner diameters of the bearings should be precise with low tolerance. Manufacturing difficulty and cost are significantly increased.

SUMMARY

Thus, an object of the present invention is to provide an electric coolant pump that is easy to process and low in cost.

According to one aspect, an electric coolant pump is provided. The electric coolant pump includes a pump house, a motor connected to the pump house, and an impeller housed in the pump house and driven by the motor. The motor includes a stator and a movable unit rotatably mounted within the stator. The stator is provided with a central shaft. The movable unit includes a support body, a bearing assembly fixedly embedded in the support body, a rotor core fixed to the support body, and a plurality of permanent magnets attached to the rotor core. The bearing assembly includes at least one bearing rotatably sleeved on the central shaft. The support body is formed by an injection-molding process to wrap the bearing assembly and fixed connecting bearing assembly and the rotor core.

According to another aspect, a manufacturing method for the movable unit above is provided. The manufacturing method includes integrating the rotor core and the permanent magnets, and forming the support body, and integrating the pre-integrated permanent magnets and rotor core, and the bearing assembly. In integrating the rotor core and the permanent magnets, the permanent magnets are inserted into the rotor core, and then a protective sleeve is formed to wrap the rotor core by a first process of insert-molding. In forming the forming the support body, the pre-integrated permanent magnets and rotor core, and the bearing assembly is positioned in an injection tooling, with the bearing assembly sleeved by the rotor core, and then a resin material is injected into the injection tooling to form the support body connecting the pre-integrated permanent magnets and rotor core, and the bearing assembly by a second process of insert-molding.

BRIEF DESCRIPTION OF THE DRAWINGS

A preferred embodiment of the disclosure will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
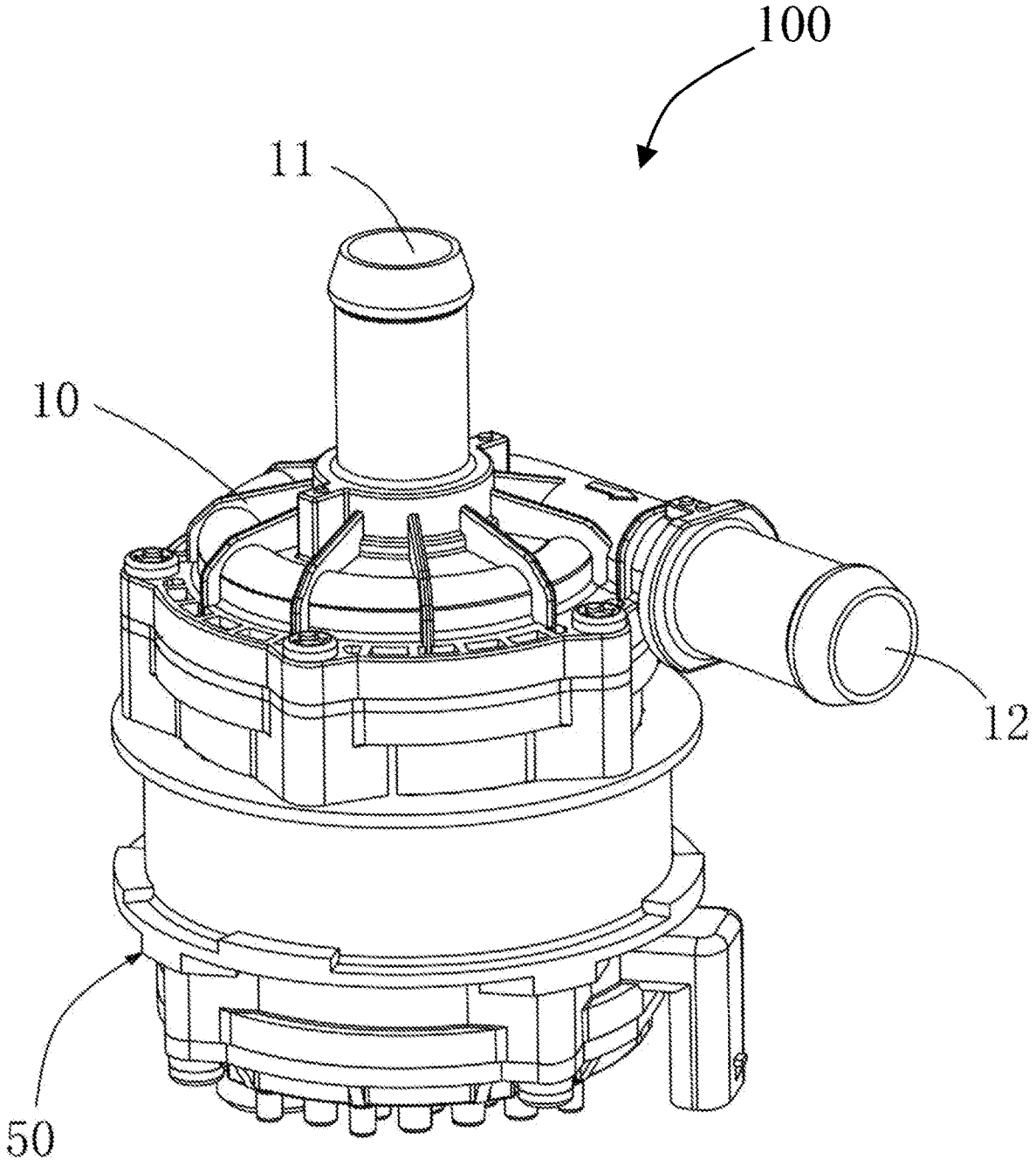
FIG. 1 is a perspective view of an electric coolant pump according to a first embodiment of the present invention.

The subject matter will be described in conjunction with the accompanying drawings and the preferred embodiments. The described embodiments are only a few and not all of the embodiments of the present disclosure. All other embodiments obtained by those ordinarily skilled in the art based on the embodiments of the present disclosure without any creative efforts fall within the protection scope of the present disclosure. It is to be understood that, the drawings are provided for reference only and are not intended to be limiting of the invention. The dimensions shown in the drawings are only for convenience of illustration and are not intended to be limiting.

It should be noted that when a component is considered to be "connected" to another component, it can be directly connected to another component or may also have a centered component. Unless otherwise defined, all technical and scientific terms used herein have the same meaning as commonly understood by those ordinarily skilled in the art. The terminology used in the specification of the present disclosure is only for the purpose of describing particular embodiments and is not intended to limit the invention.

Figure 2:
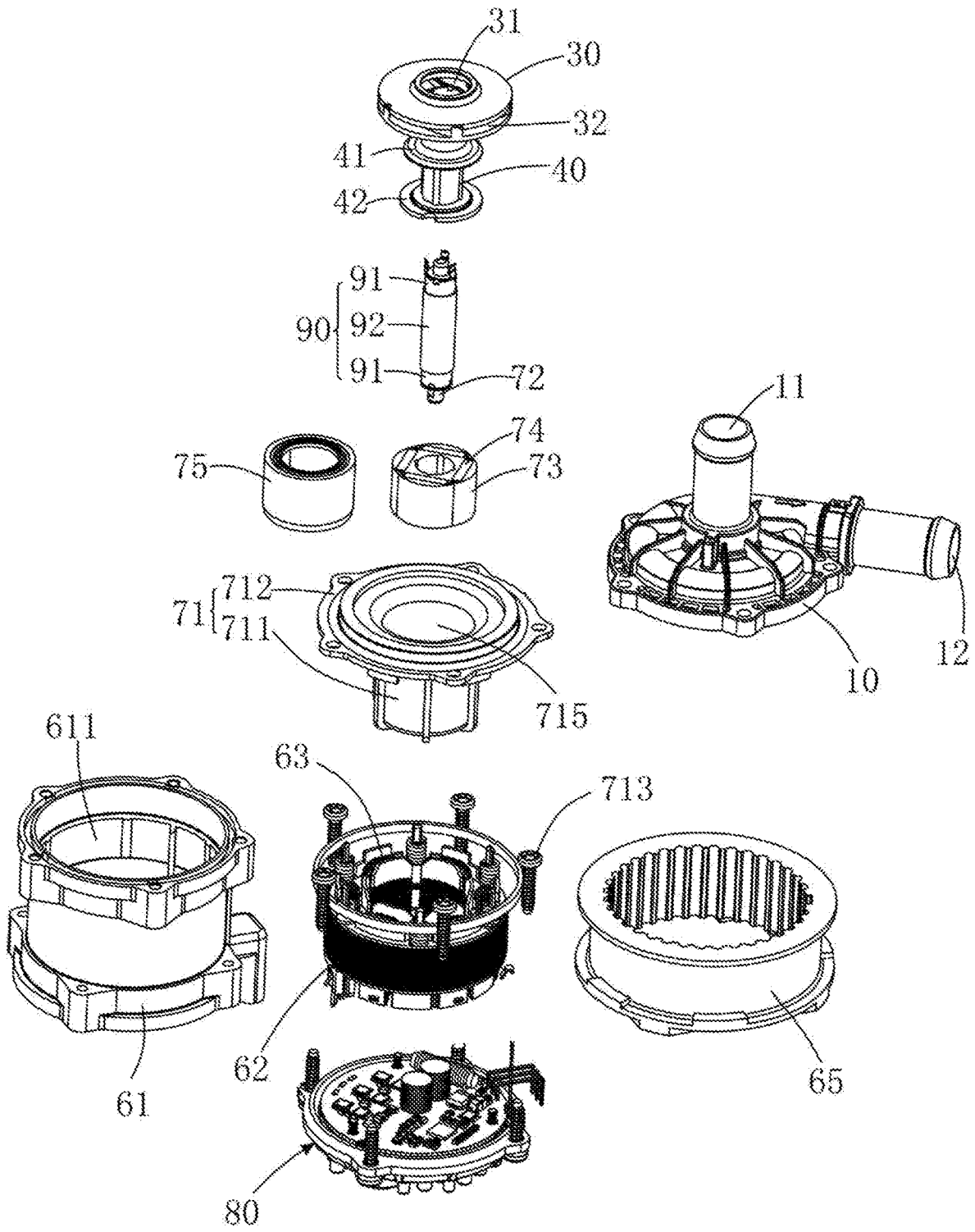
FIG. 2 is an exploded view of FIG. 1.

Referring to FIGS. 1 and 2, an electric coolant pump 100 of a first embodiment includes a pump house 10, a motor 50 connected to the pump house 10, and an impeller 30 housed in the pump house 10 and driven by the motor 50. The pump house 10 has a pump inlet 11 and a pump outlet 12. When the motor is powered, the impeller is driven to rotate in the pump house 10, coolant flow into the pump house 10 via the pump inlet 11 and exhaust outer of the pump house 10 via the pump outlet 12.

Figure 3:
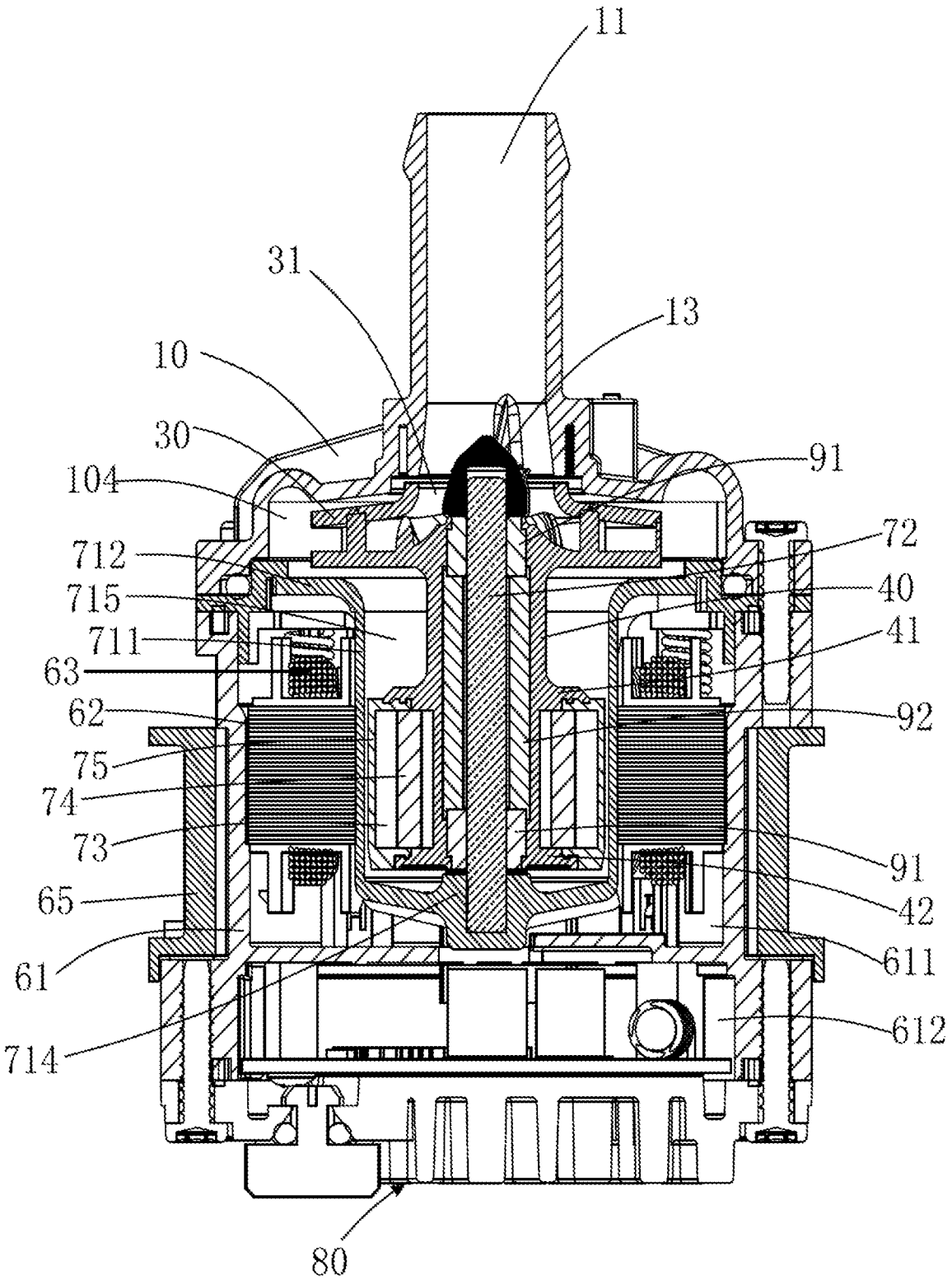
FIG. 3 is a cross-sectional view of FIG. 1.

Referring also to FIG. 3, the motor 50 is an inner rotor motor including a stator and a movable unit rotatably mounted within the stator.

The stator includes a cylindrical stator outer casing 61, a stator inner casing 71, a stator core 62 disposed between the stator outer casing 61 and the stator inner casing 71, a stator winding 63 wound around the stator core 62, and a central shaft 72 fixed in the stator inner casing 71. An end (top end in FIG. 3) of the stator outer casing 61 and an end (top end in FIG. 3) of the stator inner casing 71 are connected to the pump house 10. The movable unit is housed in the stator inner casing 71 and is rotatably sleeved on the central shaft 72. The stator inner casing 71 includes a cylindrical portion 711 opened at one of opposite ends (top end in FIG. 3) and closed at the other end (bottom end in FIG. 4) with a bottom plate, and an annular flange 712 surrounding the open end of the cylindrical portion 711. The annular flange 712 is fixed to the pump house 10 and is sandwiched between stator outer casing 61 and the pump house 10. An inner cavity 715 of the cylindrical portion 711 is in communication with a pump chamber 104 of the pump house 10. The impeller 30 is closed to the opening end of the cylindrical portion 711, and an impeller inlet 31 of the impeller 30 is aligned with the pump inlet 11 of the pump house 10.

Figure 4:
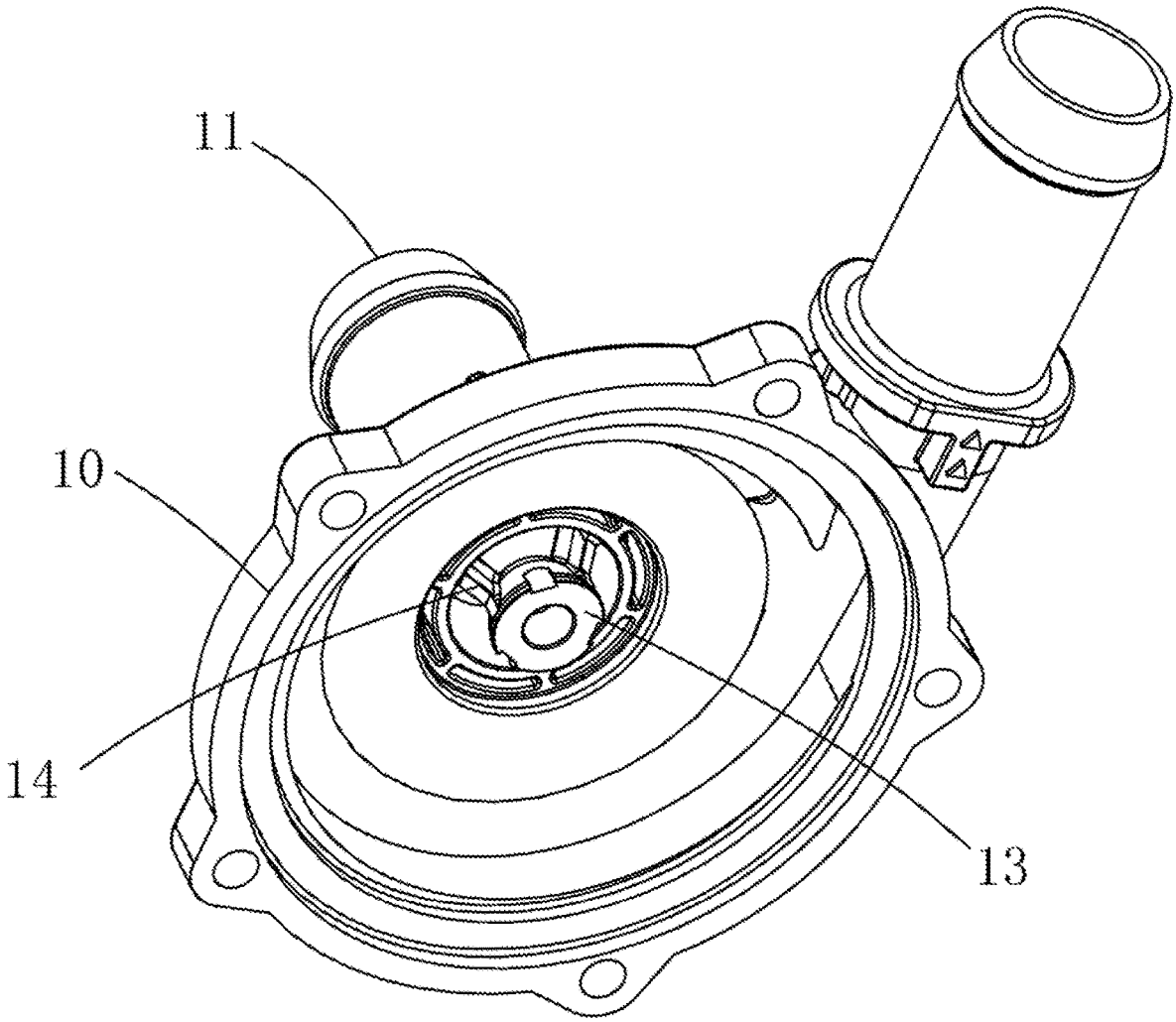
FIG. 4 is another perspective view of the pump house showed of FIG.2.

Referring also to FIGS. 3 and 4, one of opposite ends of the center shaft 72 is fixed to the bottom plate of the cylindrical portion 711. The other end of the center shaft 72 extends through the impeller 30 and fixed to the pump house 10. Specifically, a convex hub 714 is form on the bottom plated of the cylindrical portion 711, and the end of the central shaft 72 is fixed into the convex hub 714. A fixing member 13 is provided in the pump house 10 adjacent to the pump inlet 11. The fixing member 13 partially projects into the impeller inlet 31. The end of the central shaft 72 is fixed to the fixing member 13. Preferably, the fixing member 13 is provided with a plurality of connecting arms 14 through which the fixing member 13 is attached to the pump house 10. In one embodiment, the plurality of connecting arms 14 includes three connecting portions 14 which are evenly distributed along a circumferential direction of the fixing member 13.

Figure 5:
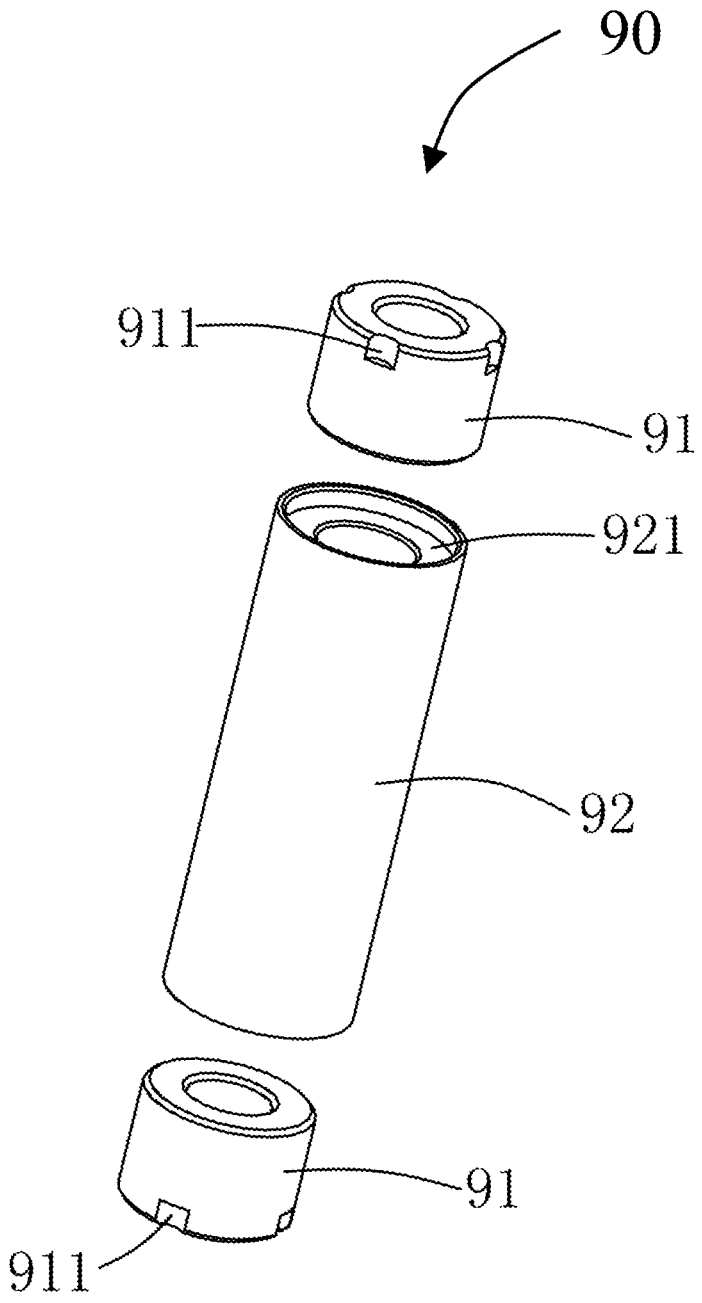
FIG. 5 is further exploded view of the bearing assembly of the pump body shown of FIG. 2.

Referring to FIG. 5, the movable unit is accommodated in the inner cavity 715 of the stator inner casing 71. The movable unit includes a support body 40 defining a central through hole, a bearing assembly 90 fixed to the support body 40, a rotor core 73 fixed to and an end of the support body 40, and a plurality of permanent magnets 74 embedded in the rotor core 73.

Figure 6:
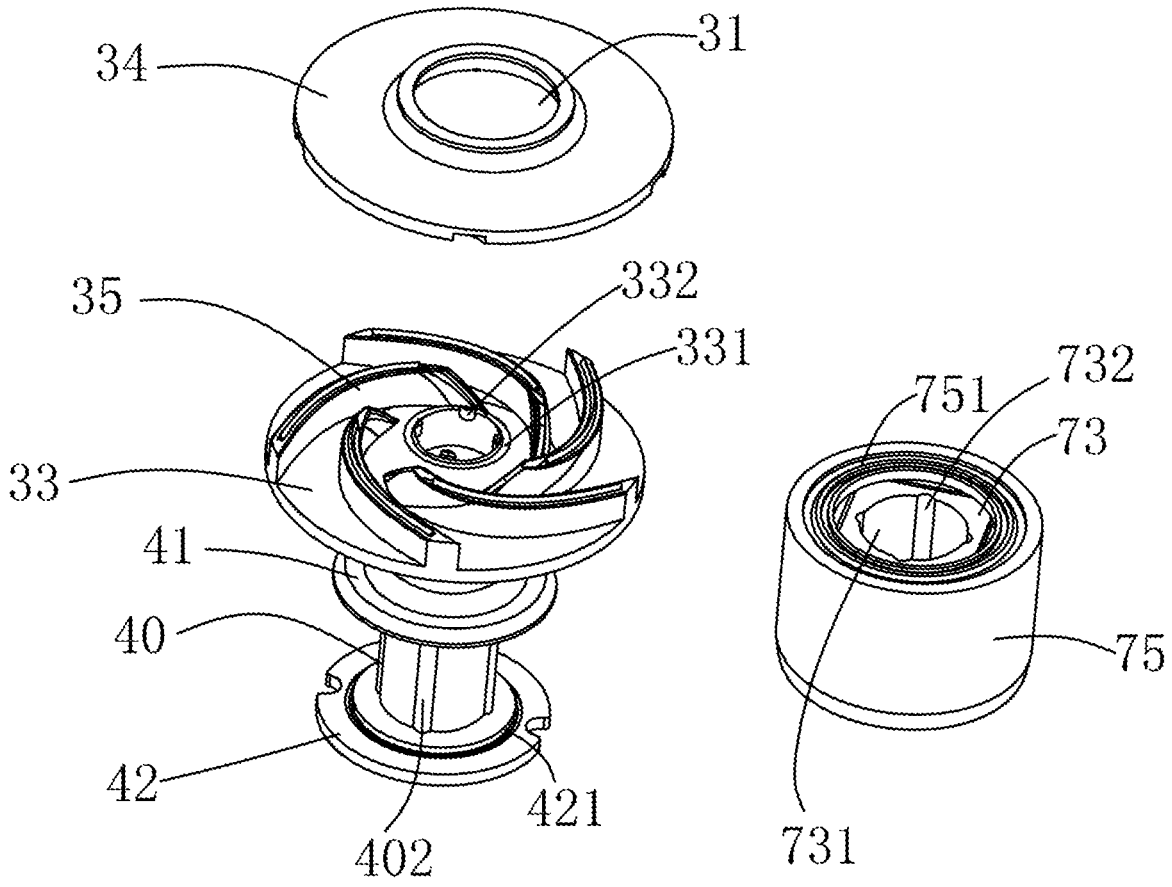
FIG. 6 is an enlarged perspective view of the impeller, the support body, the protective sleeve, and the rotor core shown of FIG. 2.
Figure 7:
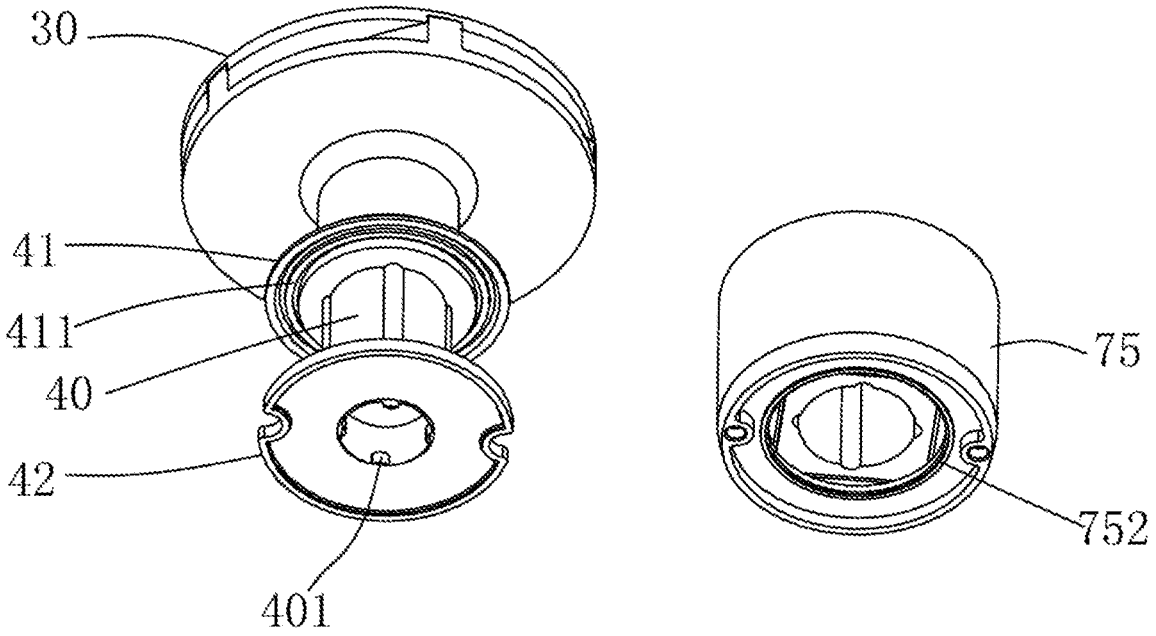
FIG. 7 is another perspective view of the impeller, the support body, and the protective sleeve of FIG. 6.

Referring to FIGS. 6, and 7, the rotor is rotatably supported by the central shaft 72 through the bearing assembly 90.

The bearing assembly 90 includes a cylindrical positioning sleeve 92 and two bearings 91 positioned at opposite ends of the positioning sleeve 92, respectively. The positioning sleeve 92 is hollow with an inner diameter of the positioning sleeve 92 is larger than the inner diameter of the bearings 91. In one embodiment, the two bearings 91 are bushing made of graphite or a material having a low coefficient of friction. It can be understood that in other embodiments, the two bearings 91 may also be ball bearings. In assembly, the two bearings 91 are in friction fit with the central shaft 72, and the positioning sleeve 92 is in clearance fit with the central shaft 72 to prevent the positioning sleeve 92 from interfering with the central shaft 72. The two bearings are supported and linked with each other by the positioning sleeve 92, to improve coaxiality of the two bearings 91. In one embodiment, opposite axial ends of the positioning sleeve 92 respectively defines a positioning groove 921. Therefore, the two bearing 91 can respectively partially embedded in the corresponding positioning grooves 91 to make it convenient for alignment of the two bearings 91.

The impeller 30 includes a bottom bezel 33, a cover bezel 34 opposite and spaced apart from the bottom bezel 33, and a plurality of vanes 35 connected between the bottom bezel 33 and the cover bezel 34. The cover bezel 34 defines the pump wheel inlet 31.

In one embodiment, the bottom bezel 33 and the vane 35 are integrally formed with the support body 40, and the cover bezel 34 is detachably fastened to the top end of the vane 35. Specifically, in a process of insert-molding, the support body 40, the bottom bezel 33 at one end of the support body 40, and the bottom bezel 33 on the top side of the bottom plate 33 formed. At the same time, the bearing assembly 90 is fixedly embedded in the support body 40. By this process, the step of mounting the impeller 30 to the support body 40 can be omitted, and the step of mounting the bearing assembly 90 is also omitted, thereby simplifying the manufacture method.

To improve the connection strength between the bearing assembly 90 and the support body 40, a plurality of recesses 911 is defined in outer surface of each bearing 91. The support body 40 respectively forms a plurality of bosses 332, 401 correspondingly snapped into the recesses 911. The engagement of the recesses 911 and the bosses 332, 401 help to prevent a rotation of the two bearings 91 relative to the support body 40.

Before the support body 40 is formed, integrating the rotor core 73 and the permanent magnets 74 are executed. Specifically, the permanent magnets 74 are embedded in the rotor core 73 and then the rotor core 73 are wrapped with a protective sleeve 75 by a first process of insert-molding. Then, the integrated assembly of the permanent magnets 74, the rotor core 73, and the protective sleeve 75, and the bearing assembly 90 are further connected with a second process of insert-molding, in which the support body 40 is formed simultaneously. Therefore, the movable unit is integrated as a whole rotatably mounted to the central shaft 72.

Specifically, the protective sleeve 75 is formed in the first process of insert-molding with resin. The protective sleeve 75 covers both axial ends and circumferential surface of the rotor core 73. The support body 40 is provided with a first annular ring 41 and a second annular ring 42 axially spaced from and substantially parallel to each other. The rotor core 73 is fixed to the support body 40 and sandwiched between the first and second annular rings 41. As such, the protective sleeve 75 mates with the support body 40 to cover all of the outer and inner surfaces of the rotor core 73, preventing the rotor core 73 and the permanent magnets 74 from being destroyed by the coolant to be conveyed. It can be understood that in other embodiments, the rotor core 73 and the permanent magnets 74 may be fixed to the support 40 by means of pasting or the like.

In one embodiment, sides of first annular ring 41 and the second annular ring 42 facing each other are respectively provided with a plurality of ripples 411 and 421. Two axial ends of the protective sleeve 75 respectively define engagement grooves 751, and 752 that are configured to correspondingly engage with the ripples 411 and 421 to improve the bonding strength between the protective sleeve 75 and the support body 40.

An outer circumferential surface of the support body 40 is formed with a plurality of ribs 402 extending in the axial direction between the first connecting portion 41 and the second connecting portion 42. Inner wall of a through hole 731 of the rotor core 73 defines a plurality of recesses 732 extending in the axial direction. In forming of the support body 40, the ribs 402 correspondingly engage with the recesses 732 to improve the bonding strength between the support body 40 and the rotor core 73. In one embodiment, the plurality of ribs 402 includes four ribs 402 evenly distributed along a circumferential direction of the support body 40. Correspondingly, the plurality of the recesses 732 includes four recesses 732.

Referring to FIG. 2 and FIG. 3 again, the stator outer casing 61 is sleeved by a mounting bracket 65 for mounting the electric coolant pump 100 in place. A first accommodating space 611 and a second accommodating space 612 are formed in the stator outer casing 61 along the axial direction of the electric coolant pump 100. The stator core 62 and the stator inner casing 71 are mounted in the first accommodating space 611. A controller 80 is mounted in the second accommodating space 612 and electrically connected to the stator winding 63 for power supply of the winding 63 and driving the electric coolant pump 100.

In one embodiment, the cylindrical portion 711 of the stator inner casing 71 is located in a space bounded by stator teeth of the stator core 62. The annular flange 712 of the stator inner casing 71 is close to the pump house 10, and one end of the pump house 10, the outer ring portion 712, and the stator outer casing 61 is detachable fixed to each other by a plurality of fasteners 713 such as a screws or the like.

Since the stator inner casing 71 and the pump house 10 are in a sealed connection, the stator core 62 and the controller 80, which are mounted outside of the inner casing 71 are prevented from being immersed in the coolant and damaged.

Figure 8:
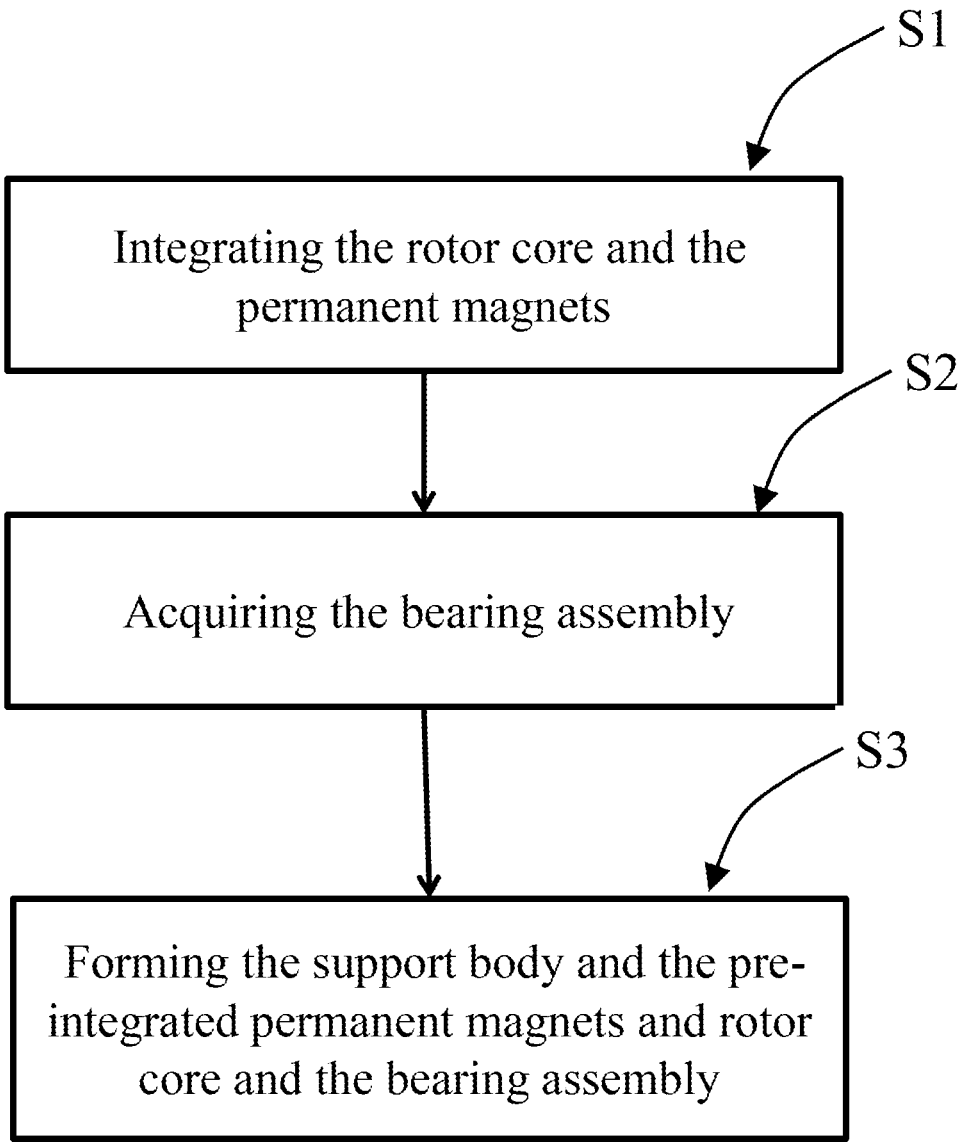
FIG. 8 is a flowchart of a manufacturing method of a movable unit of the electric coolant pump according to an embodiment of the present invention.
Figure 9:
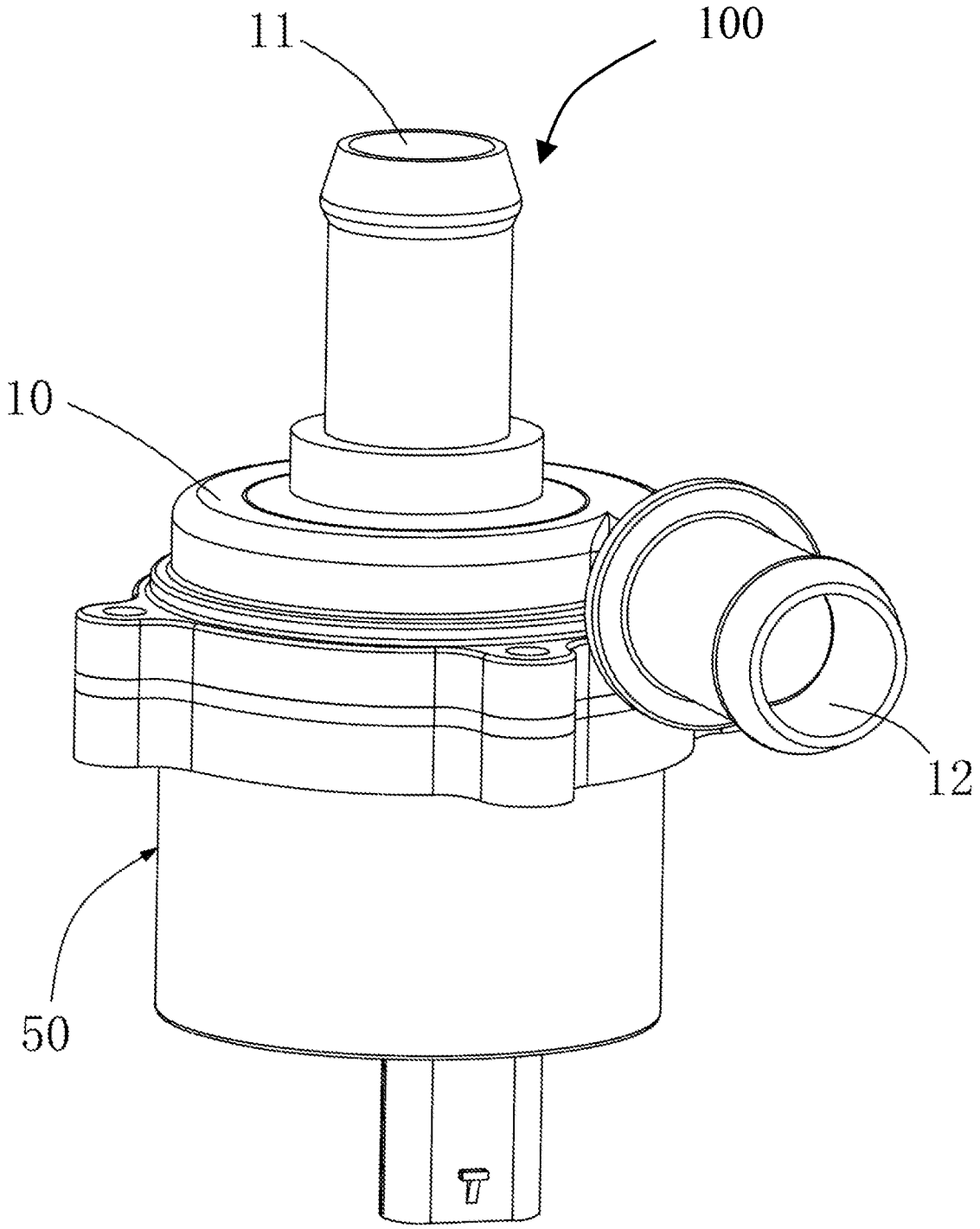
FIG. 9 is a perspective view of an electric coolant pump according to a second embodiment of the present invention
Figure 10:
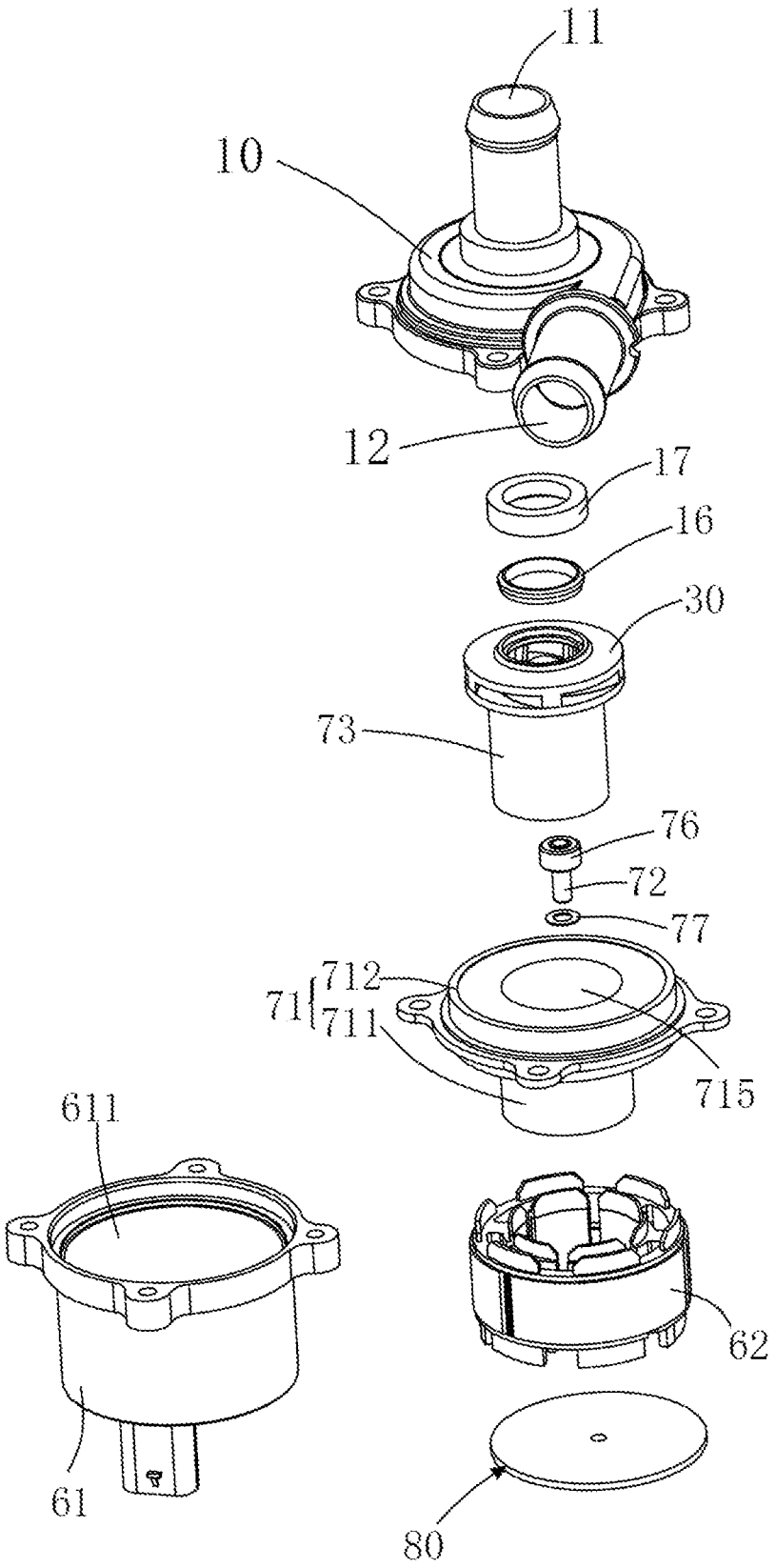
FIG. 10 is an exploded view of FIG. 9.
Figure 11:
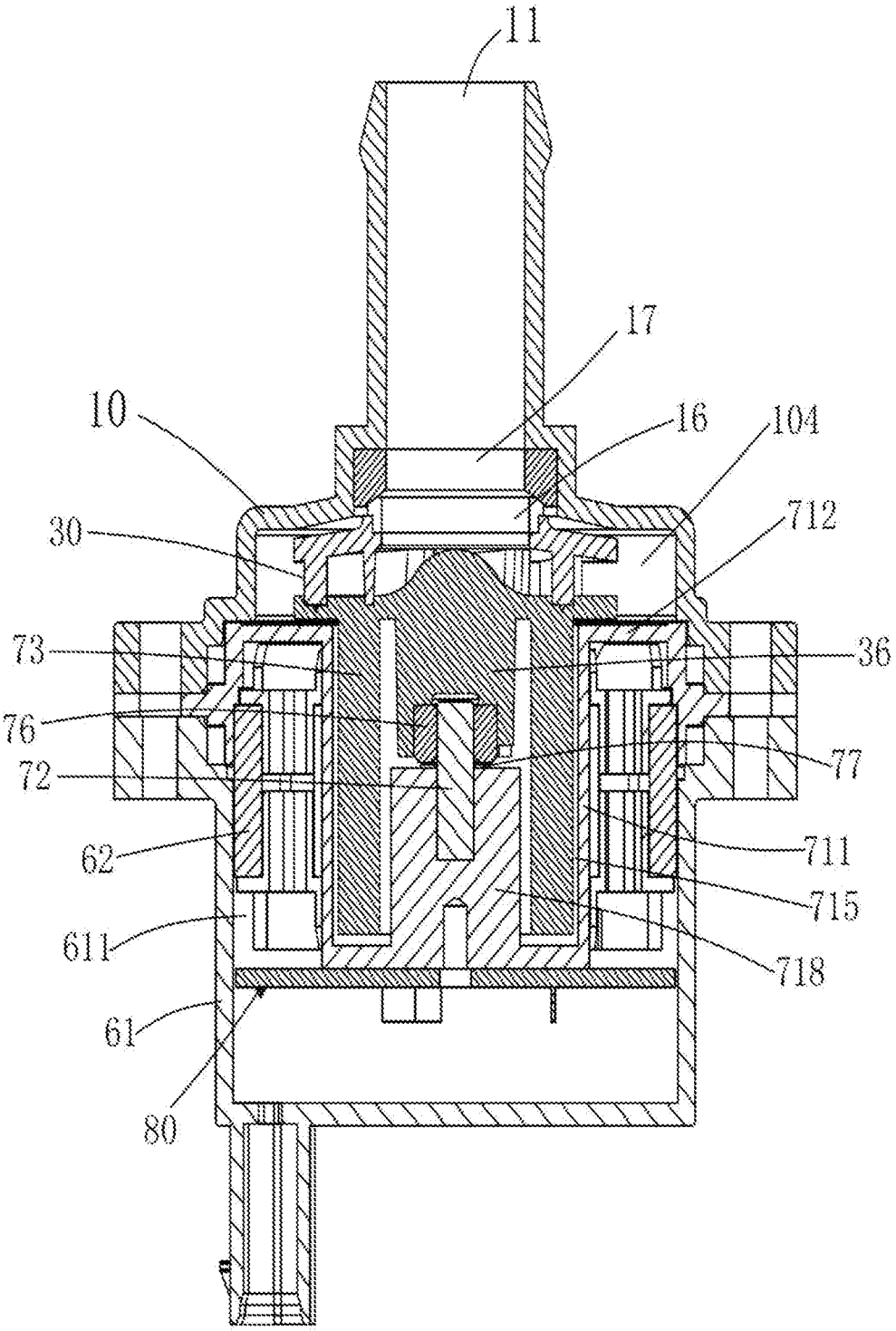
FIG. 11 is a cross-sectional view of FIG. 9.
Figure 12:
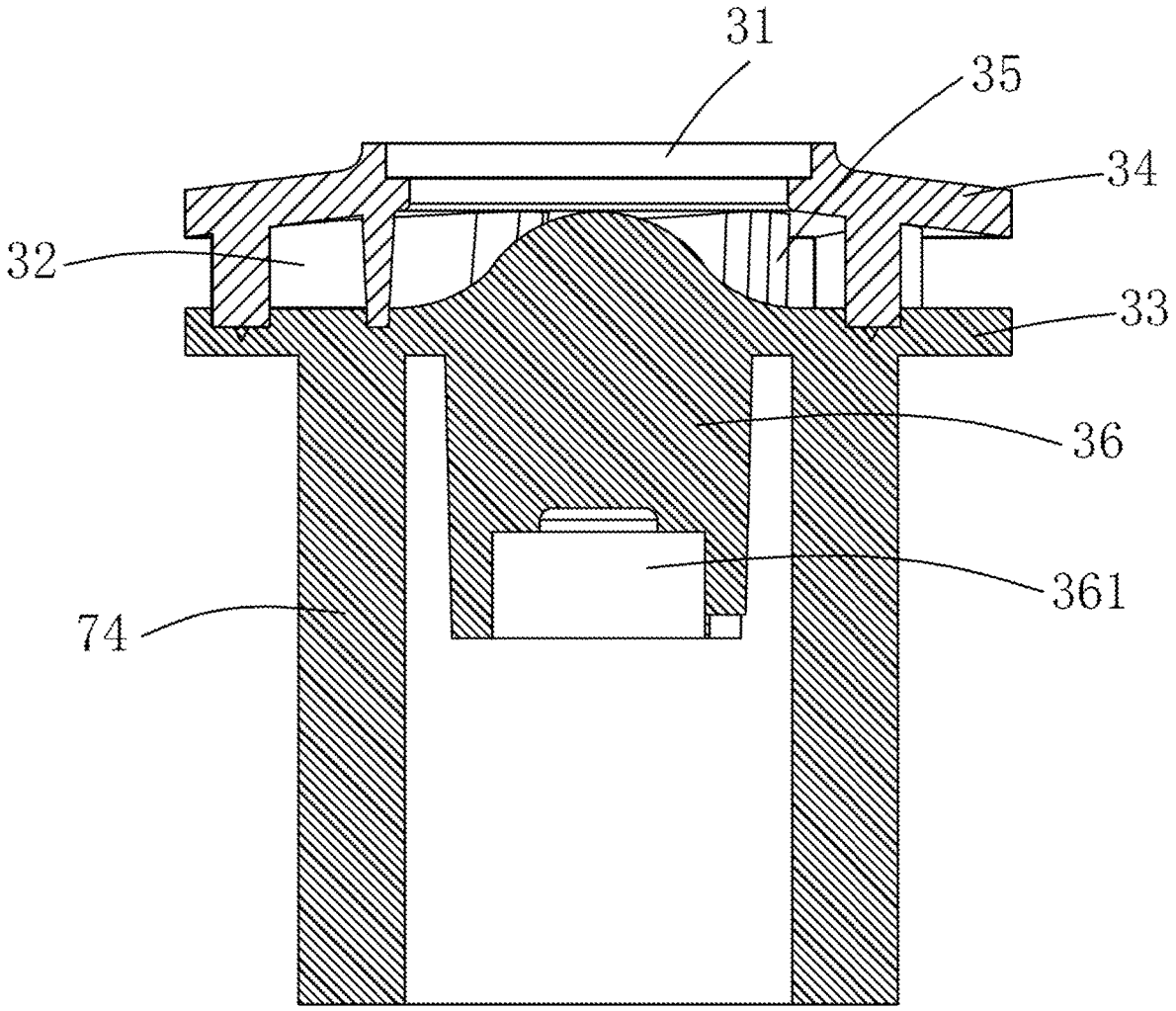
FIG. 12 is a cross-sectional view of the movable unit of FIG. 10.

Referring to FIG. 8, the present invention also provides a manufacturing method for the movable unit of the electric coolant pump 100. The manufacturing method includes steps of:

S1: Integrating the rotor core 73 and the permanent magnets 74. In step S1, the permanent magnets 74 are inserted into the rotor core 73 and then the rotor core 73 are wrapped with the protective sleeve 75 by a first process of insert-molding. The protective sleeve 75 covers both axial ends and circumferential surface of the rotor core 73.

S2: Acquiring the bearing assembly 90. In step S2, The two bearings 90 and the positioning sleeve 92 are provided. Then, the two bearing 91 are respectively embedded in the positioning grooves 91 defined at opposite ends of the positioning sleeve 92 to axially align the two bearing 91 and the positioning sleeve 92.

S3. Forming the support body 40 and the pre-integrated permanent magnets 74 and rotor core 73 formed by step S1 and the bearing assembly 90 acquired in step S2. In step S3, the bearing assembly 90, and the pre-integrated permanent magnets 74 and rotor core 73 are positioned in an injection tooling, with the bearing assembly 90 sleeved by the rotor core 73. Then a resin material is injected into the injection tooling to form the support body 40 to connect the pre-integrated permanent magnets 74 and rotor core 73, and the bearing assembly 90 by a second process of insert-molding. A gap between an outer circumferential wall of the bearing assembly 90 and an inner wall of the rotor core 73 is filled with the resin material.

In one embodiment, the first and second annular rings 41 of the support body 40 are respectively fixed to the two axial ends of the protective cover 75 and thereby sandwiching the rotor core 73 therebetween.

The bearing assembly 90 of the movable unit is mounted to the central shaft 72 by the separate bearings 91 adjacent to opposite axial ends of the central shaft 72 to improve stability of the rotation of the movable unit. The two bearings 91 are positioned and assembled by the positioning sleeve 92, high coaxiality of the two bearings 91 can be easily achieved. Mounting of the bearing assembly 90 with an injection-molding process will be benefit for simplifying the manufacturing process.

It can be understood that the order between steps S1 and S2 is interchangeable. Alternatively, steps S1 and S2 can be executed simultaneously. Anyway, both of steps S1 and S2 should be completed before step S3.

Referring to FIGS. 9 to 12, an electric coolant pump 100 of a second embodiment of the present invention includes a pump house 10, a motor 50 connected to the pump house 10, and an impeller 30 housed in the pump house 10 and driven by the motor 50.

In the second embodiment, a movable unit of the motor 50 includes a support body 36, a bearing assembly fixedly embedded in the support body 36, a rotor core 73 fixed to the support body 36, and a plurality of permanent magnets (not shown) embedded in the rotor core 73. As compared to the first embodiment, the bearing assembly in the second embodiment includes only one bearing 76. The reduction in components can result in lower cost.

Specifically, in the second embodiment, a bottom plate of the cylindrical portion 711 of the stator inner casing 71 is provided with a raised portion 718. A bottom end of the central shaft 72 is fixed in the raised portion 718. The bearing 76 is sleeved on the top end of the central shaft 72. Since the raised portion 718 extends upward to the middle of the cylindrical portion 711, the central shaft 72 can be shorten and more than a half of the central shaft 72 in a longitudinal direction is embedded in the raised portion 718. So that, even if only one end of the central shaft 72 supports the movable unit, the central shaft 72 is stiff enough to stably support the movable unit. A mounting hole 361 is defined in an end of the support body 36 closed to the raised portion 718. The bearing 76 is fixedly mounted in the mounting hole 361. The bearing 76 is rotatable engaged with the central shaft 72 such that the movable unit and the impeller 30 are rotatable relative to the central shaft 72. Preferably, the bearing 76 is seated on the raised portion 718, a spacer 77 with a small friction coefficient is interposed between a top end of the raised portion 718 and a bottom of the bearing 76 to reduce the friction between the bearing 76 and the raised portion 718.

In the second embodiment, the impeller 30 includes a bottom bezel, a cover bezel opposite and spaced apart from the bottom bezel, and a plurality of vanes connected between the bottom bezel and the cover bezel. The support body 36 is integrally formed with the bottom bezel of the impeller 30, and the vanes are integrally formed with the cover bezel. The integrated of cover bezel and vanes is detachably fastened to a top side of the bottom bezel of the impeller 30.

A sealing member is disposed between an impeller inlet 31 of the impeller 30 and a pump inlet 11 of the pump house 10. In the second embodiment, the sealing member includes an anti-friction ring 17 and a spacing ring 16 that is rotatable relative to the anti-friction ring 17. The anti-friction ring 17 is mounted to an inner wall of the pump house 10, and the spacing ring 16 is mounted to the impeller 30 and surrounds the impeller inlet 31. A central through hole is in alignment and communicates with the pump inlet 11 and the impeller inlet 31. The sealing member is located in a gap between the pump house 10 and the impeller 30 to block coolant from leaking via the gap, thereby increasing the efficiency of the electric coolant pump 100.

The stator outer casing 61 is cylindrical and defines a first accommodating space 611. The stator core 62, the stator inner casing 71, and the controller 80 are mounted in the accommodating space 611, and the drive circuit 80 is mounted to a bottom of the cylindrical portion 711 of the stator inner casing 71.

The above descriptions are only preferred embodiments of the present disclosure, and are not to limit the present disclosure. Any changes, equivalents, modifications and the like, which are made within the spirit and principle of the present disclosure, shall fall within the protection scope of the present disclosure.

The invention claimed is:

1. An electric coolant pump, comprising a pump house;

a motor connected to the pump house and comprising:

a stator with a fixed central shaft; and a movable unit rotatably mounted within the stator, the movable unit comprising a support body, a bearing assembly connected to the support body, a rotor core fixed to the support body and a plurality of permanent magnets attached to the rotor core, the bearing assembly comprising a cylindrical positioning sleeve and two bearings positioned at opposite ends of the positioning sleeve, the positioning sleeve and the bearings are sleeved on the central shaft, the positioning sleeve is in clearance fit with the central shaft, the two bearings rotatably supported on the central shaft, wherein the support body is formed by an injection-molding process to wrap the bearing assembly and fixedly connecting bearing assembly and the rotor core, the bearings are fixedly connected to the positioning sleeve through the support body being directly overmolded by the injection-molding process on both the bearings and the positioning sleeve;

an impeller housed in the pump house and driven by the motor.

2. The electric coolant pump of claim 1, wherein opposite axial ends of the positioning sleeve respectively defines a positioning groove, the two bearings are respectively embedded in the positioning grooves of the positioning sleeve.

3. The electric coolant pump of claim 1, wherein one of the bearings is fixed to the impeller and the other one bearing is fixed to an end of the support body away from the impeller.

4. The electric coolant pump of claim 1, wherein an inner diameter of the positioning sleeve is larger than that of the bearings.

5. The electric coolant pump of claim 1, wherein at least part of the impeller is integrally formed with the support body by the injection-molding process.

6. The electric coolant pump of claim 5, wherein the impeller comprises a bottom bezel, a cover bezel opposite and spaced apart from the bottom bezel, and a plurality of vanes connected between the bottom bezel and the cover bezel, the plurality of vanes is integrally formed with the bottom bezel.

7. The electric coolant pump of claim 1, wherein the support body is provided with a first annular ring and a second annular ring axially spaced from and substantially parallel to each other, the rotor core is sandwiched between the first and second annular rings, the rotor core are wrapped with a protective sleeve, the protective sleeve mates with the support body to cover all of the outer and inner surfaces of the rotor core.

8. The electric coolant pump of claim 1, wherein a plurality of recesses is defined in an outer surface of each of the bearings, the support body forms a plurality of bosses correspondingly snapped into the recesses.

9. The electric coolant pump of claim 1, wherein the stator further comprises a cylindrical stator outer casing, a stator inner casing, a stator core disposed between the stator outer casing and the stator inner casing, a stator winding wound around the stator core, the movable unit is housed in the stator inner casing, an end of the stator outer casing and an end of the stator inner casing are fixed to the pump house.

10. The electric coolant pump of claim 9, wherein the stator inner casing comprises a cylindrical portion opened at one of opposite axial ends and closed at the other end with a bottom plate, and an annular flange surrounding the open end of the cylindrical portion, the annular flange is fastened to the pump house, an inner cavity of the cylindrical portion is in communication with a pump chamber of the pump house.

11. The electric coolant pump of claim 10, wherein one of opposite ends of the central shaft is fixed to the bottom plate of the cylindrical portion, and the other end of the central shaft is fixed to the pump house through the impeller.

12. The electric coolant pump of claim 1, wherein each of the two bearings is a bushing made of graphite or a material having a low coefficient of friction, and is in friction fit with the central shaft.

13. A manufacturing method for the movable unit of the electric coolant pump of claim 1, comprising:

integrating the rotor core and the permanent magnets, comprising inserting the permanent magnets into the rotor core, and then forming a protective sleeve wrapping the rotor core by a process of insert-molding;

preparing the bearing assembly by providing the positioning sleeve and two bearings positioned at opposite ends of the positioning sleeve; and forming the support body, and integrating the pre-integrated permanent magnets and rotor core, and the bearing assembly, comprising positioning the pre-integrated permanent magnets and rotor core, and the bearing assembly in an injection tooling, with the bearing assembly sleeved by the rotor core, and then injecting a resin material into the injection tooling to form the support body fixedly connecting the pre-integrated permanent magnets and rotor core, the bearings and the positioning sleeve by the injection-molding process.

14. The manufacturing method of claim 13, wherein in forming the support body by the injection-molding process, a gap between an outer circumferential wall of the bearing assembly and an inner wall of the rotor core is filled with the resin material.

15. The manufacturing method of claim 13, preparing the bearing assembly comprises respectively embedding the two bearings at two positioning grooves respectively defined in two opposite ends of the positioning sleeve to axially aligned the two bearings and the positioning sleeve.

* * * * *